US005938084A

United States Patent [19]

Fuchs et al.

[11] Patent Number: 5,938,084

[45] Date of Patent: Aug. 17, 1999

[54] DISPENSER FOR MEDIA

[75] Inventors: Karl-Heinz Fuchs, Radolfzell; Hans Merk, Gaienhofen, both of Germany

[73] Assignee: Caideil M.P. Teoranta, Tourmakeady, Ireland

[21] Appl. No.: 08/803,046

[22] Filed: Feb. 19, 1997

[30] Foreign Application Priority Data

Feb. 22, 1996 [DE] Germany ..... 196 06 701

[51] Int. Cl.[6] ..... B05B 11/00; B05B 1/34

[52] U.S. Cl. ..... 222/321.2; 222/321.9; 239/333

[58] Field of Search ..... 222/321.1, 321.2, 222/321.7, 321.8, 321.9, 341, 385, 477; 239/463, 468, 333

[56] References Cited

U.S. PATENT DOCUMENTS

| | | | |
|---|---|---|---|
| 2,989,251 | 6/1961 | Abplanalp et al. | 239/468 |
| 3,075,708 | 1/1963 | Cooprider | 239/490 |
| 3,084,873 | 4/1963 | Corsette | 239/337 |
| 3,191,814 | 6/1965 | Corsette et al. | 222/385 |
| 4,017,031 | 4/1977 | Kishi | 239/333 |
| 4,051,983 | 10/1977 | Anderson | 239/333 |
| 4,071,172 | 1/1978 | Balogh | 222/321.7 |
| 4,247,048 | 1/1981 | Hayes | 239/333 |
| 4,311,256 | 1/1982 | DeArmitt | 239/333 |
| 4,991,747 | 2/1991 | Van Brocklin | 222/321 |
| 5,147,087 | 9/1992 | Fuchs | 239/333 |
| 5,192,006 | 3/1993 | Van Brocklin et al. | 222/321.9 |
| 5,518,377 | 5/1996 | Bougamont et al. | 222/341 |
| 5,791,527 | 8/1998 | Giuffredi | 222/321.9 |

FOREIGN PATENT DOCUMENTS

| | | |
|---|---|---|
| 0 505 900 A1 | 3/1992 | European Pat. Off. . |
| 84 15 785 U | 5/1984 | Germany . |
| 30 47 839 C2 | 8/1984 | Germany . |
| 38 34 091 C2 | 7/1990 | Germany . |
| 40 41 136 A1 | 2/1992 | Germany . |
| 41 37 799 A1 | 5/1993 | Germany . |
| 42 07 800 C1 | 9/1993 | Germany . |
| 29506682 U 1 | 10/1995 | Germany . |
| 44 39 443 A1 | 9/1996 | Germany . |

*Primary Examiner*—J. Casimer Jacyna
*Attorney, Agent, or Firm*—Quarles & Brady LLP

[57] ABSTRACT

A dispenser (1) has a medium outlet (19) oriented transversely to the actuating direction, and guiding surfaces (54) defined by a nozzle body (52) that is configured integrally with the plunger (27). The guiding surfaces (54) are provided between adjoining circumferential surface areas of the piston stem (65) and the discharge head (12), so that no separate, external nozzle cap is required to provide the desired atomizing spray pattern.

23 Claims, 4 Drawing Sheets

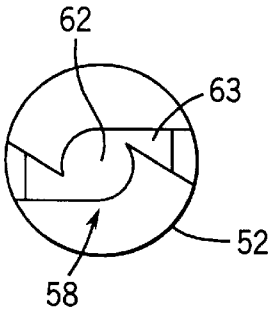
FIG. 4
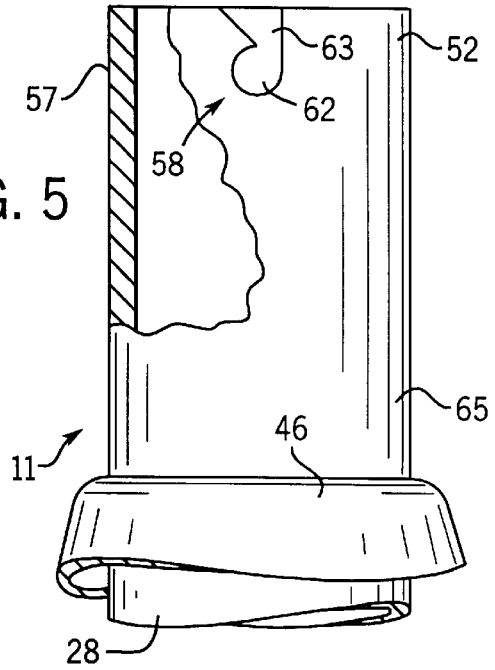
FIG. 5
FIG. 6
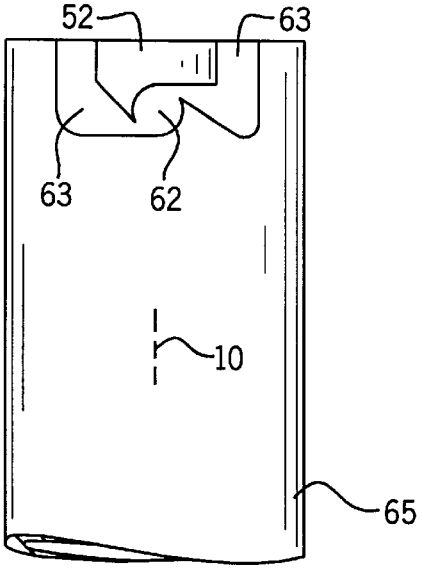
FIG. 7
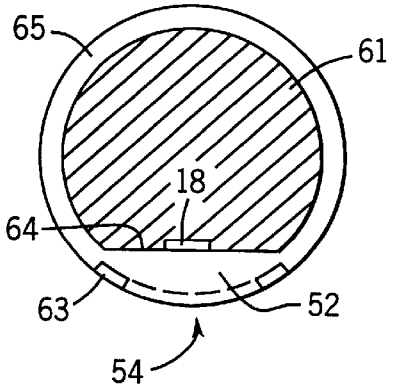

DISPENSER FOR MEDIA

TECHNICAL FIELD

The invention relates to a dispenser for media which may be liquid, gel-like, powdery, gaseous or similar.

To guide the medium in its movement or flow in the dispenser, at least one medium outlet is provided, at which the medium can be released from the dispenser to the environment or, however, output into a chamber upstream of this last outlet. To swirl the flow of a fluid medium, to cause it to execute a vortex movement or to atomize it, guiding surface areas deflecting singly or multiply are assigned to the medium outlet which are formed by a sole or two separate outlet bodies and define flow passages or flow chambers. In this arrangement the last chamber downstream adjoins the end of an integral passage section, the other end of which forms the medium outlet and which passes through the associated outlet body. Upstream this chamber is connected to an outlet passage, whereby further guiding surface areas of the guiding means may be provided between this outlet passage and the chamber which affect transversely to the axis of the medium outlet an acceleration and orientation of the flow.

If one of the two separate outlet or nozzle bodies is formed by a nozzle cap, the medium outlet passing through the cap bottom of the latter, the cap may be torn from its mount by the pressure of the medium. Furthermore, this nozzle body having a through-width of less than one millimeter is very small and thus difficult to install. The nozzle body needs to be fabricated independently of other components of the dispenser, for example, sliding sealing members of a piston unit or the like at great expense. Such sealing members are provided in dispenser e.g. to seal off the pressure or plunger chamber and to change the volume thereof by movements of the sealing member.

SUMMARY OF THE INVENTION

The invention is based on the object of defining a dispenser in which the drawbacks of known configurations or of the kind as described are avoided and more particularly permits a simple configuration of the guiding means even when the axis thereof or the axis of the medium outlet fails to coincide with the center axis of the pressure chamber or a position axially parallel thereto.

In accordance with the invention at least one outlet body of the guiding means is configured substantially integral with a sealing member for a pressure chamber. This preferably applies to the outlet body located upstream and a sealing member configured as a piston lip which slides uninterruptedly on a cylindrical runway defining the pressure chamber circumferentially and thus sealing off the pressure space or some other housing space in each actuating position.

Preferably the axis of the output of the guiding means is located transversely or at right angles to the main axis of the dispenser, whereby the outlet axis may intersect this main axis. The main axis may be the center axis of the housing space, pressure chamber, piston unit, pump housing and/or the discharge head. With respect to this axis the guiding means is located offset to one side in radial spacing.

It is of advantage when only one of the two outlet bodies is. provided with a recess, the defining surface areas of which form the guiding surface areas, whilst the nozzle passage passes through the other outlet body. The recess is expediently provided at an outer circumferential surface area, for example a surface area curved concavely about the main axis or the like. This surface area may be formed by a piston stem which transmits the discharge actuating forces to the sealing member, with which it is expediently configured integrally. An end protrusion or the sleeve-shaped end of this piston stem thus forms the corresponding inner outlet body and the guiding surface areas. The surface of the outlet body or stem facing away from the guiding means, i.e. for example the inner circumferential surface area may define the outlet passage porting directly or via a short transverse passage the guiding means. The outer nozzle body directly defining the nozzle passage and the medium outlet may be configured integrally with the discharge head which also serves for manually actuating the dispenser.

Due to the configuration as described the guide chambers and guide passages of the guiding means are defined by complementary inner and outer circumferential surface areas which are sealingly juxtaposed adjacent to the guiding spaces and leave only one connection to the upstream adjoining section of the outlet passage and in the nozzle passage free. The communicating connection to the outlet passage is expediently located at an end edge of the outlet body or stem and at a bottom surface area of a receiving recess for the outlet body, this bottom surface area being located opposite to this end edge. The side flanks of this recess opposing each other may receive the outlet body between them so that e.g. they adjoin firmly seated both circumferential sides of the outlet body facing away from each other and define, on the one hand, the outlet passage and, on the other, the guide spaces of the guiding means.

These and further features are evident also from the description and the drawings, each of the individual features being achieved by themselves or severally in the form of subcombinations in one embodiment of the invention and in other fields and may represent advantageous aspects as well as being patentable in their own right, for which protection is sought in the present.

BRIEF DESCRIPTION OF THE DRAWINGS

Example embodiments of the invention are explained in more detail in the following and illustrated in the drawings in which:

FIG. 4 is a face end view of the inner outlet or nozzle body as shown in FIG. 3, FIG. 5 is a section of a unit of the dispenser shown in FIG. 2 in a partially sectioned view, FIG. 6 shows a further embodiment of a unit according to FIG. 5 and FIG. 7 shows a unit according to FIG. 6 as viewed from above.

DETAILLED DESCRIPTION

Figure 1:
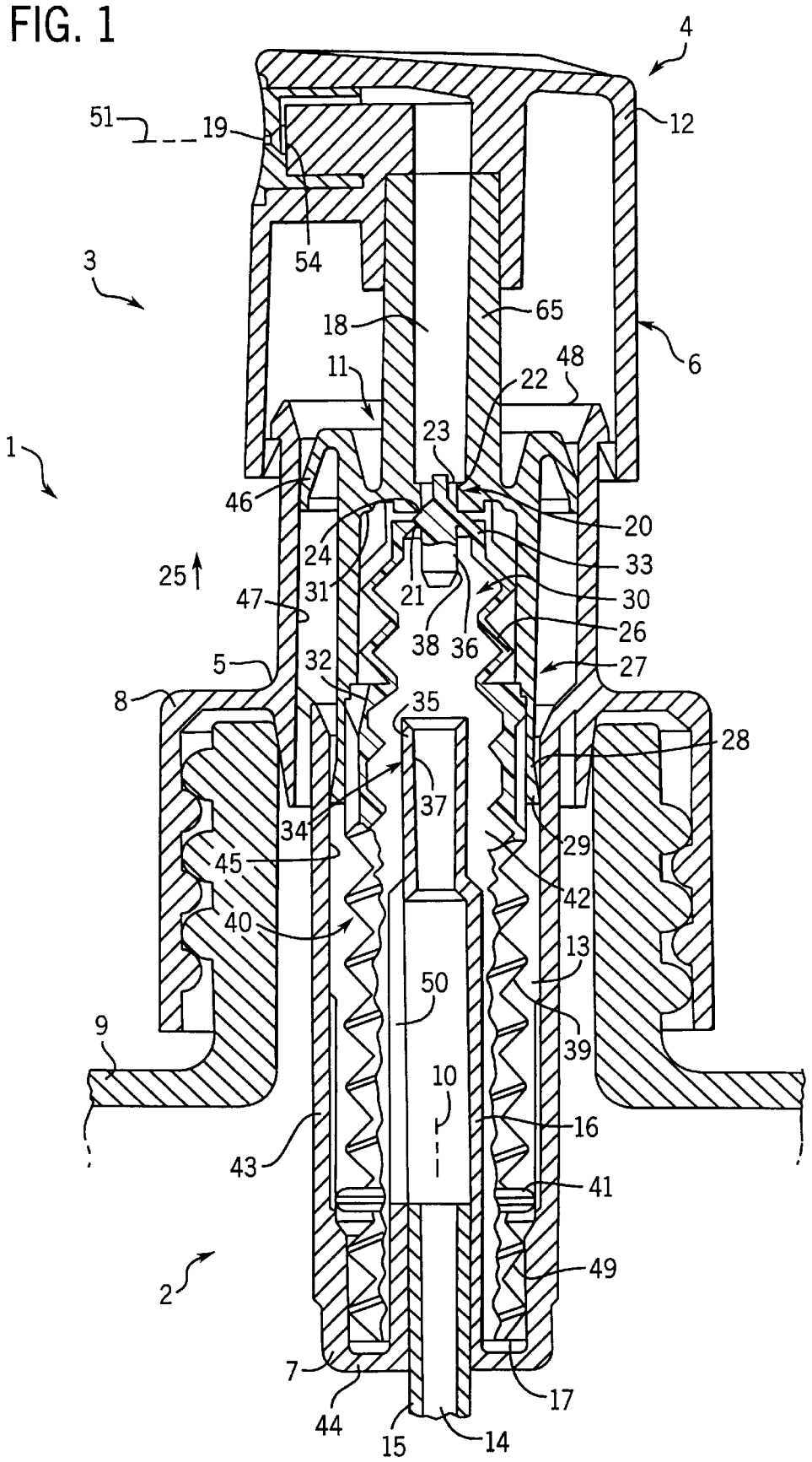
FIG. 1 shows an axial section of a dispenser according to the invention

The dispenser may be configured in accordance with the patent application U.S. Ser. No. 628603, this being the reason why reference is made to this patent application as regards the features and effects of the present application.

The dispenser 1 comprises two units 2, 3 which can be moved manually with respect to each other over a working movement, such as a linear stroke, these units accordingly forming a discharge actuation 4. For actuation the dispenser is to be held in one hand and actuated by the fingers thereof so that it is shortened and thereby the medium therein subjected to a discharge pressure. Each of the units 2, 3 comprises a separate base body 5, 6 each of which is an integral component and which may form the outermost surface area of the device 1.

The elongated base body 5 of the inner unit 2 forms an elongated housing 7 which is to be secured by a fastener member 8 to the neck of a reservoir 9 firmly positioned so that it lies by the majority of its length within the vessel 9. The cited components are located in a middle or main axis 10 of the device 1.

The unit 3 contains an elongated displacement or piston unit 11 and a discharge or actuating head 12 located outside of the base body 5, 6, this head forming the base body 6. This base body 6 may be configured integrally with the unit 11 and formed by a component separate from the latter. In the housing 7 an elongated pressure or pump chamber 13 is provided which is defined by its outer circumference as well as by its inner end of the housing and by the outer end of the unit 11. Outside of the inner end of the housing 7 an inlet 14 is provided for the pressure chamber 13 which may be formed by a filling or suction tube which directs the medium from the bottom region of the reservoir 9 by suction into the housing 7 and in the pressure chamber 13. From the inner end of the housing 7 protruding thereinto is a protusion or port 16 into which the medium flows from the outer end of the flexible tube 15. In the housing 7 a further inlet directly adjoining the pressure chamber 13 is provided, via which the medium output by the port 16 flows directly into the pressure chamber 13. The connection between inlet 14, 17 and pressure chamber 13 may be configured free of any valve or provided with a valve which closes when pressure builds up in the pressure chamber 13 and opens when a vacuum exists in the chamber 13 for drawing in a further medium charge.

Passing through the unit 6, 11, adjoining the chamber 13, is an outlet passage 18 via which the medium is supplied pressurized to the medium outlet 19 provided in the head 12. At the outlet 19 the medium is released from the device 1 to the environment. Between the chamber 13 and the passage 18 a closure 20, namely an outlet valve, is provided, the actuator 4 also forming a closure actuator for repeatedly opening and closing the closure 20. The closure 20 contains only two closure parts 21, 22 in each case with which a closure passage 23 directly adjoining the passage 8 can be closed pressure-tight in one position in the region of closing surfaces areas 24 and in the other position is opened so that the medium flows between the closing surfaces areas 24 from the chamber 13 into the passages 23, 28. The through-flow direction 25 of the closure 20 in this arrangement is from inside out, namely oriented so that the medium flows via the inlet 14 into the housing 7, out of the chamber 13 and along the passage 18. The actuator movement of the unit 3 is as compared to this oriented conversely. The closure part 21 totally located within the unit 11 is loaded by a spring 26 towards the closing position, this spring being mounted or retained totally at the unit 11.

The unit 11 forms by its inner end a cup-shaped piston 27 having a cylindrical tubular piston cuff 28, the inner end of which is configured as a sealing lip 29, sealing off the chamber 13 throughout its circumference. At the outer end the piston 27 comprises a face end wall as a piston crown 31 which is located exclusively within the piston shell 28, forming the outer closure part 22 and through which the passage 23 passes centrally. The inner closure part 21 is locked in place by a sleeve-shaped and dimensionally rigid carrier body 32 with respect to the piston 27 so that it is able to execute axial relative movements with respect to the piston 27. The carrier body 32 engages, spaced away from the closure part 21, the inner circumference of the piston shell 28 rigidly positioned so that it protrudes beyond the sealing lip 29 into the chamber 13. The carrier body 32 is connected to the closure part 21 exclusively by the spring 26, these components possibly forming a preassembled or integral unit. To affect the opening movement of the closure part 21 against the force of the spring 26, which is always preloaded, when subjected to the vacuum in the chamber 13, a plunger 33 is provided which is expediently formed by the closure part 21 and is configured integrally therewith.

For the closure 20 delay means 30 are provided which cause the closure 20, on opening of the closure actuator 4, to remain open longer than would be the case if it would be controlled solely by the pressure in the chamber 13 acting on the plunger 33. This pressure drops below the operating pressure mostly on commencement of the return stroke of the unit 11 at the latest, so that then the spring 26 would return the closure 20 instantly to its closed position. This is prevented for a short time by the means 20 so that the closure 20 recloses not before part of the return stroke has been executed or at the end thereof, the volume of the chamber 13 being reduced by the working stroke and enlargened as of commencement of the return stroke. For the delay the unit 2 comprises a closure holder 34 when retains the closure part 21 in the open position with respect to the base body 5 even when the unit 3 executes relative movements or the return stroke and thus the closure part 22 is removed outwardly from the closure part 21.

The holder 34 comprises on the housing 7 and totally within the latter a holding member 35 which may be formed by the freely protruding and slightly constricted end of the port 16. The pin-shaped or tubular shaped holding member 35 may be closed circumferentially and open at the free end, it being located contactlessly within the chamber 11 at which it does not need to adjoin, with respect to which it is able to execute minor radial movements in all directions, however, due to the flexibility of the port 16. To retain the closure part 21 or the plunger 33 in the cited position a counter member 36 is provided which may be configured integrally with the parts 21, 33 and in the starting position as shown in FIG. 1 protrudes contrary to the direction 25 away from the closing surface area 24 with an intermediate spacing freely and coaxially against the holding member 35.

The members 35, 36 comprise complementary engaging or friction surface areas 37, 38 which, with the closure part 21 open, when the spring 26 is maximally tensioned, engage each other with a predetermined friction at the end of the actuating stroke of the actuator 4. The friction surface area 37 of the holding member 35 is formed by an inner circumference and the friction surface area 38 by an outer circumference. On actuation the friction surface area 38 approaches the friction surface area 37 from its spacing position until it glides into the holding member 35 via guide-in ramps and in the further course of this coupling and insertion movement the friction increases. At the end of this movement the counter member 36 is center-located by resting friction with respect to the holding member 35 and with respect to the body 5, 7 when the closure 20 is still closed.

When a compressible medium, such as air, is present in the chamber 13, the pressure build-up on the working stroke is not sufficient as a rule to open the closure part 21 or completely so that this air is able to escape sufficiently through the closure 20 into the passage 18. If the return stroke of the unit 6, 11 commences at the end of the working stroke the closure part 21 is first held in place by the friction surface areas 37, 38 with respect to the unit 5, 7 so that the closure part 22 is distanced from the closure part 21. At the same time the spring 26 urges the closure part 21 in the direction of the closure part 22 or the closing position to a degree in which the resting friction is overcome. The counter member 36 thus slides with reduction of the frictional force along the friction surface area 37 until it releases therefrom, the closure part 21 then being accelerated by the force of the spring 26 and translated free of friction into the closing position. In this closing position the closing surface areas 24 then come into contact with each other firmly positioned, whereby the closing surface areas may be formed by complementary conical surfaces areas and more particularly the closing surface area of the closure part 21 being an outer cone.

During the extended opening time of the closure 20 the trapped air has adequate time to expand and as a result of this to escape into the passage 18, this also being promoted by non-gaseous medium being drawn into the chamber 13 via the inlet 14, 17. This medium may flow from the end of the holding member 35 against the inner side of the piston 33 facing away from the control surface area. Since the friction surface areas 37, 38, in the unused condition of the device 1, are still dry, the friction is initially higher. The clamping seat between the friction surface areas 37, 38 is then wetted, however, by the cited means with the non-gaseous medium so that in the sense of a reduction in the frictional force by the medium a lubrication materializes which facilitates liberation by the closure holder 34. In addition, the friction surface areas 37, 38 may be configured so that they wear out relatively quickly after a few working strokes at least to the extent that following venting of the pressure chamber 13 the holding force is diminished to such an extent that the closure 20 closes at the end of the working stroke or at the commencement of the return stroke.

The pressure-dependent opening travel of the closure 20 is substantially smaller than the opening travel resulting from the means 30 so that when the opening pressure is attained in the chamber 13 the closure 20 opens in the way as described, before the closure holder 34 engages. To ensure, more particularly in the case of a large opening travel, a centered location of the closure part 21 in the sole closing position, members for centering slide guidance of the closure part 21, the spring 26 or the piston 33 may be provided, for instance, as guiding lands on the inner circumference of the shell 28, a centering projection protruding into the passage 23 in the closing position only, or the like. These members may remain engaged over the full opening travel of the pressure-controlled opening and disengage on opening by the means 30 so as to then assume the centered location on closing movement of the closure part 21 even when the closure part 21 approaches an off-center location with respect to the centering means.

The return movement of the units 2, 3 with respect to each other is caused by a return spring 39 located within the housing 7 in the axis 10 which, like the spring 26, is configured as a resiliently torsioned compression spring. Like the spring 26 and all carrier bodies 32, 41, the spring 39 defines the annular chamber 13 at the inner circumference and is supported by its corresponding end at the piston 27 via the carrier body 32. Its outer and inner width is greater than that of the spring 26 so that it is contactless with respect to the cylindrical bore or runway 45. The other end of the spring 39 is supported firmly positioned via the carrier body 41 by the inner circumference of the housing 7 spaced away from the housing bottom 44.

Belonging to a preassembled or integral unit 40 are the parts 21, 26, 32, 33, 39, 41 the carrier body 32, 41 in each case being connected by a snap-action connection or a press-fit to the inner side of the associated sleeve such that the medium is able to bypass the latter, namely along its outer circumference which, where needed, is provided with recesses or through-openings. Between the annular disk-shaped body 41 and the bottom 44 a tubular protrusion 49 is furthermore provided, which may have the same cross-sections as the spring 39 and which is shorter with respect thereto. The inner end of the protrusion 49 is preloaded to contact the lands at the inner side of the bottom 44 so that between the radial lands the transition 17 is formed via which the medium flows along the bottom 44 from the unit 40 radially outwards into the chamber 13. The protrusion 49 is part of the unit 40 and may centrally engage the inner circumference of the housing 7.

The unit 40 or the juxtaposed longitudinal sections thereof surround a chamber 42 which is conductingly connected to the chamber 13 only in the bottom region via the inlet 17. Protruding free of contact into the chamber 42 is the port 16 including the holding member 35 as well as the counter member 36 in the way as already described. Like the chamber 13, the chamber 42 too is constricted on the working stroke and expanded on the return stroke. Each of the longitudinal sections 26, 39, 49 located one after the other, defining the shell of the chamber 42, is formed by an axially compressible, resilient tube section, the outer circumference and/or inner circumference of which forms threadlike one or more pitch spirals, namely spiral grooves and spiral lands therebetween such that the shell thickness is approximately constant throughout. As compared to this the carrier body 32 or 41 feature a greater wall thickness, more particularly a greater shell thickness so that it is not elastically deformed in operation. Due to the pitch spirals the end of the spring 39 supported by the unit 11, 32 is twisted with respect to the unit 5, 7 about the axis by a predetermined amount, for example more than 30°. The frictional force between the end of the unit 40, 49 and the bottom 44 of the chamber 13 is only sufficient to cause the supported end of the section 49 to be included in the twist by an amount, small in comparison, of for example approximately 10°, before being rendered stationary, however. As a result of this the spring 39 retains, in addition to the axial return tension, a return torsion about the spring axis 10, as a result of which the spring force is elevated. Included in the rotation is that of one of the two carrier bodies 32, 41, especially the body 41. A corresponding torsional movement is also executed by the spring 26.

The shell 43 of the housing 7 defining the storage volume of the reservoir 9 by its outer circumference forms with the inner circumference also the runway 45 for the piston end 29 and translates integrally into the bottom 44 through which the tube 15 passes. Adjoining the bottom integrally is the port 16 into which the tube 15 protrudes in a press fit. Following the outer end of the runway 45 is a runway 47 which is widened with respect to the latter formed by the housing shell on which a further piston 46 of the unit 11 runs sealed throughout circumferentially so that this alone suffices to close off tight the outer end 48 of the housing shell. The piston 46 is located axially spaced away from the piston lip 29 in the region of the piston crown 31 and is configured completely integrally with the piston 27.

As evident from FIG. 1 the port 16 or the holding member 35 protrudes into the piston 27 and the carrier body 32. A transfer opening 50, for example a longitudinal slot, passes through the shell of the port 16, this longitudinal slot being located spaced away from the holding member 35 and the outer end of which is provided in the region of the body 41. As a result of this the free end of the port 16 or the holding member 35 including the friction surface area 37 may be closed off throughout the circumference. This end forms a further face end opening or transfer opening. The through-flow cross-sections of the transfer openings are substantially greater than those of the inlet openings 17 so that the latter act like a throttle. When both chambers 13, 42 are completely filled with medium, on the working stroke the medium is forced from the chamber 42 via the transfer openings 50 back into the reservoir 9, whereas in the chamber 13 the overpressure is generated in the way as described by means of which the medium is forced on opening of the closure 20 to the outlet 19. In this arrangement the inlet 17 acts similar to a closed inlet valve so that the medium is unable to flow from the chamber 13 or only unsubstantially via the inlet 17 back into the chamber 42. On the return stroke medium flows, on the one hand, via the port 16 and the transfer opening 50 into the chamber 42 and, on the other, simultaneously from the chamber 42 via the inlet 17 into the chamber 13, as a result of which all chambers are refilled. If, in this arrangement, the closure 20 is temporarily still to be closed, then the medium outlet 19 acts like an outlet valve as a throttle through which air cannot be drawn into the medium spaces 13, 18 or only to an unsubstantial degree.

Figure 2:
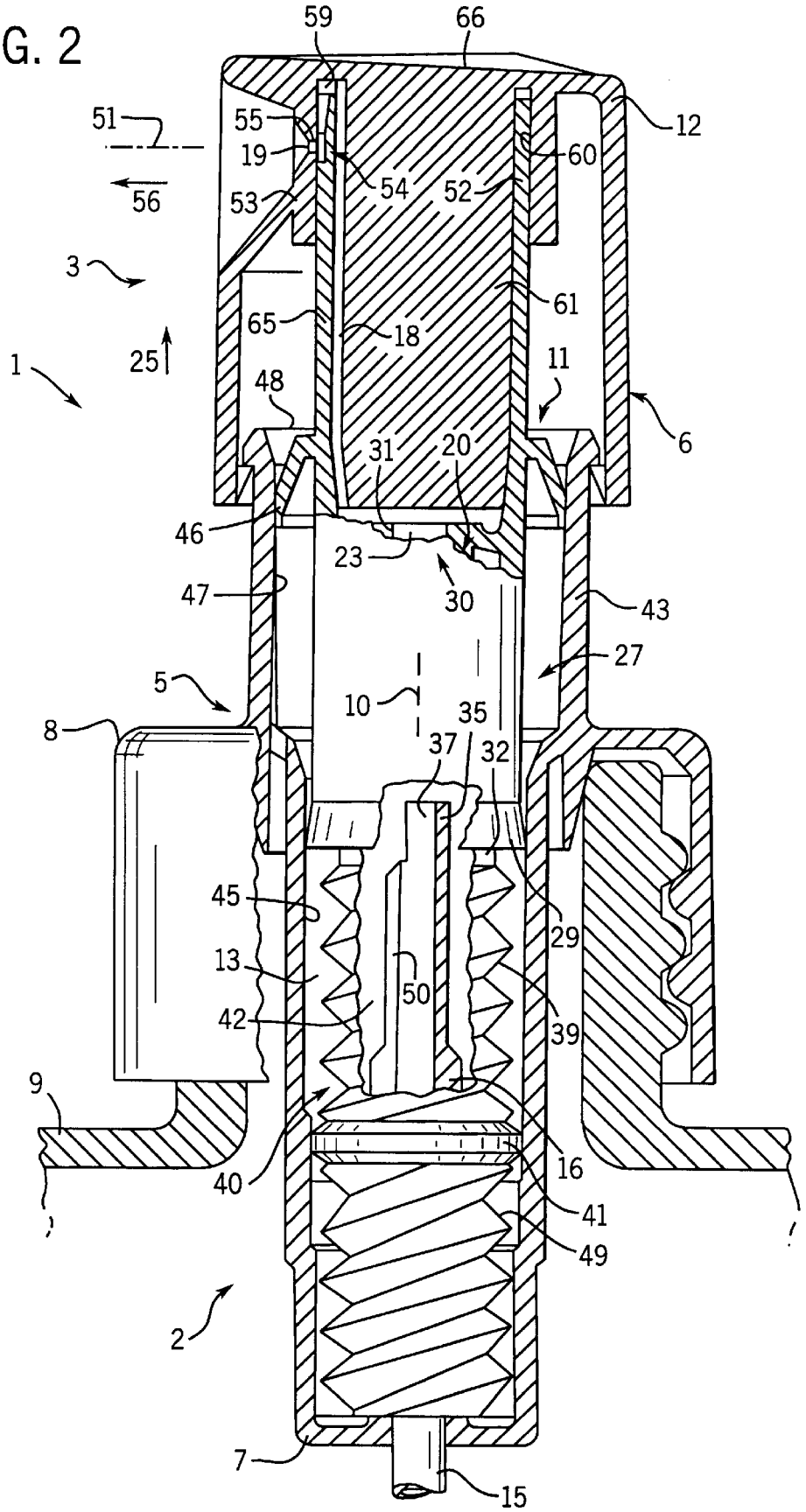
FIG. 2 is a further embodiment of a dispenser.

In the embodiment shown in FIG. 2 the holding member 35 or the friction surface area 37 is not configured throughout the circumference, but merely shell-like over an angle of curvature of more than 180°. In this arrangement the associated slot end of the transfer opening 50 may thus be opened or closed so that it does not adjoin a constricted tubular appendix as shown in FIG. 1. The carrier body 41 may also be configured so that it is included in implementing axial or rotary movements of the spring 39 and has only a centering effect so that the section 49 like the spring 39 serves as a return spring for the unit 3. The section 49 has in this arrangement roughly the same length as the spring 39.

Figure 3:
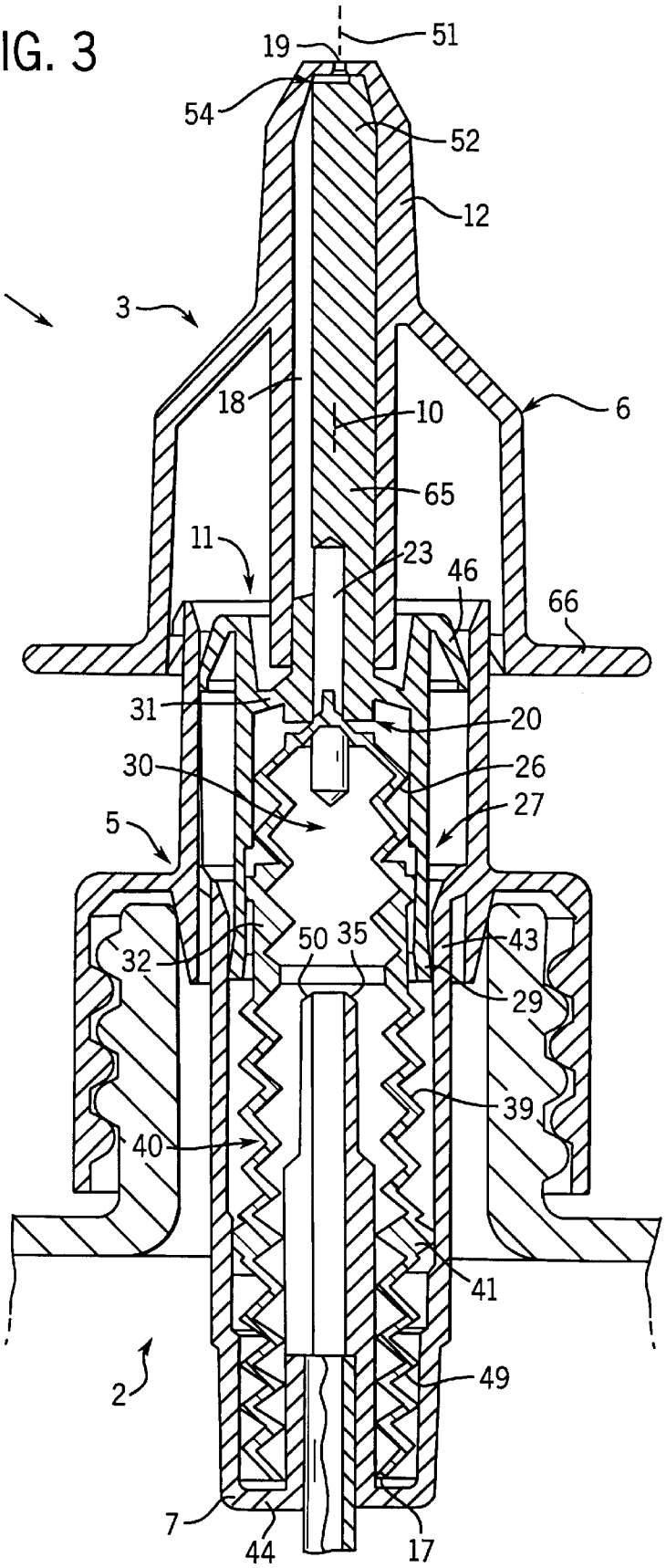
FIG. 3 shows an axial section through a further embodiment.

As evident from FIG. 3 in the starting position the holding member 35 does not protrude as far as into the piston 27, but in the final position of the working stroke also into the sections 26, 32. In this case the transition slot 50 passes through the holding member 35 up to the free end thereof. The carrier bodies 32, 41 protrude merely beyond the outer circumference of the springingly deformable sections 26, 39, 49. Via the chamber between the pistons 27, 46, defined annularly by the runway 47 and the shell 28, the reservoir 9 is vented. In this arrangement the piston 46 seals this chamber from the environment only in the starting position and opens up the openings in the actuated final position through which air is able to flow from without into this annular chamber and from there directly into the reservoir 9. The reservoir 9 is otherwise closed off tight by the base body 5 which for the reservoir opening formed by the neck of the reservoir comprises a circumferential seal configured integrally therewith.

As evident from the FIGS. 1 and 2 the outlet axis 51 of the outlet 19 is located transversely or at right angles to the axis 10 in the body 12, the direction represented by arrow 56 being oriented from the sole nozzle opening 19 away from the axis 10. The upstream located end of the end passage and nozzle passage 55 defined integrally directly adjoins a guide means 54 which as evident from FIG. 1 may be defined by the bottom of a dish-shaped nozzle cap and a nozzle core of an atomizer nozzle engaging the latter. The nozzle core is configured integrally with the body 6, 12 and the nozzle cap oriented against the axis 10 is inserted in a ring-groove shaped mount of the head 12 so that the medium flows therein oriented against the axis 51 of the guiding means, affecting in the guiding means a rotational flow about the axis 51 and is then deflected transversely or at right angles directly into the nozzle passage which may adjoin the guiding means by a section constricting in the flow direction 56. As is evident from FIG. 1 the guiding means is formed by a recess which is provided exclusively at the inner circumference of the dish shell and at the bottom surface area of the dish bottom of the nozzle body, whereby the nozzle passage passes through this bottom.

As evident from FIG. 2 the outer or second outlet or nozzle body 53, through which the straight end passage 55 and the opening 19 pass, is configured integrally with the bodies 6, 12, whilst the inner, first outlet body 52 is configured integrally with the unit 11 or at least one of the sealing members 29, 46 and is covered by the latter outwardly completely from the outer circumference of the bodies 5, 6. The recess 58, the bottom and side surfaces areas of which form the guiding surfaces areas of the means 54, is provided exclusively in the outer circumferential surface area 57 of the body 52 which is configured about the axis 10 sleeve-shaped or formed by a defined and thickened circumferential section of a sleeve shell. The recess 58 is defined at the outer circumference 57 by the inner or circumferential surface area of the body 53 which is likewise formed by a circumferential section of an integral sleeve and protrudes from the outermost face end wall of the body 12 contrary to direction 25 freely into the head 12. Within this sleeve a pin-shaped core body 61 likewise configured integral with the body 12 protrudes from the inner side of the face end wall of the body 12 and sealingly engages by its outer circumference the inner circumference of the body 52. The sleeve 53 and the carrier body 61 define a groove-shaped mount 60 defined by its groove flanks about the axis 10, at the groove flanks of which the body 52 is arranged firmly seated by its inner and outer circumferential surface area as a press-fit seal. The outlet passage 18 is practically defined by the passage 23 and the bottom 31 emanating from the inner circumference of the body 52 and by the outer circumference of the body 61 as well as being formed by a groove which may be exclusively provided in the core body 61. Between the bottom of the groove 60 and end edge of the body 52 located directly opposite a spacing is provided so that here a transverse passage 59 is formed between the end of the outlet passage 18 and in inlet of the guiding means 54. The transverse passage 59 may be configured annular throughout about the axis 10. As evident from FIGS. 5 to 7 the recess 58 forms in the axis 51 a swirl chamber 62 open only at the circumference and towards the nozzle passage 55, in which tangentially one or more swirl passages 63 port. Each groove-shaped swirl passage 63 extends up to the end edge of the body 52 and is thus directly connected to the transverse passage 59. Due to orienting surface areas the bodies 6, 12, 61 may be axially connected together with the body 11, 52 only in a single rotary position about the axis 10 so that the axes of the means 54 and of the passage 55 coincide. The medium flows from the passage 23 in the direction 25 directly against the free end surface area of the body 61, is deflected between the end surface area and the bottom 31 transversely to the axis 10 to the inlet of the passage 18 and flows therein again in the direction 25 to the transverse passage 59. In the transverse passage 59 the medium flows circumferentially as well as transversely to axis 10 alone the end edge of the body 52 directly into the inlet of the guiding passage 63 and therein against direction 25 to the chamber 62.

The unit 11 comprises a sleeve-shaped piston stem 65 configured integrally, connected directly to the head 12, which as evident from FIG. 1 totally defines the associated section of the passage 18, whilst it, as shown in FIG. 2, defining the latter only at the open longitudinal side of the groove 18. As illustrated in FIG. 2 the body 52 is formed by the outer end section of this stem 65, it substantially having the same inner and/or outer width as the remaining stem 65. The flat, circular section-shaped surfaces areas 64 lie roughly symmetrical as regards the axial plane of the means 54 which is related to the axis 10, so that the outlet passage 18 passes therethrough. For its assembly the body 52 is inserted into the body 53 in the direction 25 transversely to the axis 51. The outer face end surface area of the bottom wall of the head 12 facing away from the body 52 forms the handle 66 thereof for actuating the dispenser. In the starting position the units 2, 3 are defined with respect to each other by the force of the spring 39 so that the body 6 having stops at the end of the cap shell engages counterstops at the end 48 of the housing 7. Between the end of the sleeve 53 and the end 48 lies the stem 65 with its outer circumference within the outermost shell of the head 12 totally free so that, when actuated, it is able to travel into the housing 7 whilst the head shell tightly clasps the housing 7 at the outer circumference.

As evident from FIG. 3 the outlet axis of the opening 19 is located roughly parallel to in the axis 10 at the outermost end of the head 12 which forms a discharge port for introduction into a body cavity, for example a nasal cavity. The central stem 65 configured integrally with the body 52 and protruding as of the bottom 31 freely from the remaining unit 11, defines the passage 18 only in the region of the passage 23 completely. From the passage 23 a transverse passage leads into the groove 18, so that the outlet passage is defined from this transverse passage up to the inlet of the guiding means 54 by the outer circumference of the unit 52, 65 and by the inner circumference of the head 6, 12. This head comprises in an elongation of the nose port and in a spacing within its outermost shell an inner sleeve extending contrary to direction 25 freely protruding almost up to the bottom 31, this inner sleeve accommodating the stem 65.

The recess 58 of the guiding means 54 is, as shown in FIG. 4, provided exclusively in the outermost end surface area of the stem 52, 65 so that the passages 63 connect the outer circumference of this stem to the guiding chamber 62. The outer nozzle body is, in this case, formed by the end and face end wall of the head and nose port, as compared to which the handle 66 is set back contrary to the direction 25 and is located on both sides of the axis 10.

As evident from FIG. 5 a sole passage 63 connects the end edge of the body 52 to the chamber 62, the straight passage 63 to the chamber 62 may be constricted in the width and/or depth. As shown in the FIGS. 6 and 7 two separate passages 63 adjoining the annular passage 59 are provided for the chamber 62, both of these passages being located on both sides of the chamber 62 and each of which are angular-shaped. In one angular leg the medium flows from the passage 59 contrary to direction 25 and in the directly adjoining angular leg circumferentially towards the chamber 62, these angular legs of the two passages 63 being oriented against each other but porting into the chamber 62 with a swirling effect likewise oriented.

Each of the components of the dispenser 1 described may be fabricated of a plastics material, more particularly by injection molding, which to advantage is provided in addition to the polymer with an aggregate not consisting of a plastics material, especially one containing a metal or effective as a catalyst, namely a metallocen. The catalyst present merely in a trace amount serves to start or accelerate polymerization, as a result of which also all resulting chains of molecules are roughly the same in length and producing a very tight mol wt distribution. The co-catalyst, the transition metal complex contained therein or the metal itself may be contained in a percentage by weight of less then $1/10000000$ or $5/10000000$ in the plastics material so that the catalyst can remain in the finished component. When the catalyst has had effect it could also, however, be separated from the plastics material.

A plastics material containing polyolefin or ethene, is preferred, more particularly a polyethylene or an olefin polymer or olefin copolymer is employed, resulting in an elastomer. The metallic percentage of the metallocen may be titanium or zirconium alone or a mixture thereof where a titanocen or zirconocen is involved, this resulting in a particularly good cross-linking in the transition from the monomeric to the polymeric molecular structure or in the chaining of the molecules. A further improvement may be achieved by the plastics material containing as the molecular structure instead of a pure polymerisate a copolymer e.g. of ethylene and $\alpha$-olefin, the percentage by weight of the $\alpha$-olefin expediently being at least 3% and 40% at the most, more particularly at least 5% and 30% at the most. The $\alpha$-olefin has expediently two to six atoms of carbon.

By these configurations a substantially improvement of the plastics material can be achieved which is also easy to recycle. The plastics material is highly resistant to solvents or chemicals and has high softening temperatures, it containing few extractable components. In addition, the plastics material has no smell and no taste. It exhibits a high shock toughness, a good or dense surface quality, a low tendency to distort at elevated temperatures and a very good resistance to stress cracking.

These properties may be further improved by exposing the finish molded component to radiation, more particularly to gamma radiation, the intensity of which should be expediently at least 85 kGy and 120 kGy at the most, more particularly approximately 100 kGy. As a result of this the cross linking of the chains of molecules or the gel percentage of the plastics material can also be substantially enhanced. The cited properties are substantially improved especially as compared to plastic materials produced by hitherto conventional catalyst systems, for example with so-called Ziegler-Natta or Phillips catalysts.

Exposing the component to radiation by an electron beam accelerator may be done individually or not before it has been assembled with at least one further component or on completion of assembly of all components of the dispenser 1 so that irradiation is very simple to implement and has a sterilizing effect. All components of the device 1 consist of a plastics material so that they can be recycled in common.

Since due to this material also a very high resiliency of the component is achieved, it is preferably suitable for the springs 26, 39, 49, the sealing members 29, 46 or for the corresponding units 11, 40, whilst the remaining components may be produced of a plastics material having no aggregate. The spring in each case is configured as a kind of spiral spring, the windings of which adjoin each other not only along the spiral pitch, but are also connected to each other integrally transversely thereto via connecting sections which as compared to the spiral pitch exhibit a steeper pitch or form along the circumference of the spring the axial connections between adjacent spiral sections. As a result of this the spring may be configured as a kind of bellows. Also the carrier bodies 32, 41, the valve element 21 or 22, the plunger 33, the counter member 36 and the stem 65 including the outlet body 52 may consist of the enhanced plastics material.

All features may be provided in the case of all embodiments, this being the reason why all passages of the description apply accordingly for all embodiments. The stated properties and effects may be provided precisely or merely roughly or substantially as explained.

We claim:

1. A dispenser for discharging media comprising:

a base body (6) including an outer jacket (12) and an inner body member (53), said outer jacket (12) spacedly enveloping said inner body member (53) and defining a center axis (10), said outer jacket (12) and said inner body member (53) codirectionally freely projecting and being made integral with one another;

a nozzle including a nozzle duct including a medium outlet (19), said nozzle being assembled exclusively from two nozzle components including a common component (11) with a nozzle body (52) extending between said inner body member (53) and said center axis (10), said nozzle body (52) including an outer body face (57) remote from said center axis (10); and medium spaces including an outlet duct (18) and said medium outlet (19) defining an outlet axis (51), said outlet duct (18) including duct sections, a first one of said duct sections being commonly bounded by said outer body face (57) and said inner body member (53) and including media guiding means (54) including guiding surfaces for guiding the medium, said nozzle duct being bounded in one part by said inner body member (53) and traversing said inner body member (53) with said outlet axis (51) oriented transverse to said center axis (10), said common component being made in one part, said nozzle duct including an upstream nozzle end located upstream from said medium outlet (19) and directly connecting to said outer body face (57) at said media guiding means (54).

2. The dispenser according to claim 1, and further including a housing (7) bounding a housing chamber commonly with a sealing member (29, 46), wherein said sealing member (29, 46) includes a continuously annular piston lip slidingly supported on a bearing face (45, 47) of said housing (7), said sealing member (29. 46) being made in one part with said common component (11), said dispenser (1) defining an initial state in which said nozzle is maximally spaced from said housing (7), said initial state being stop limited with a stop provided on said outer jacket.

3. The dispenser according to claim 2, wherein said housing chamber includes a pressure chamber (13) defining a chamber volume, said common component (11) being provided for varying said chamber volume.

4. The dispenser according to claim 3 and further including a setting spring (39), wherein said common component (11) supports against said setting spring (39), said common component (11) extending inside said housing (7) and said outer jacket axially displaceably enveloping said housing (7), within said outer jacket and between said inner body member (53) and said housing (7) said common component (11) being freely exposed.

5. The dispenser according to claim 1, and further including an outlet closure (20) for the medium, wherein said outlet closure (20) includes a closure seat made in one part with said nozzle body (52), along said center axis (10) said closure seat being spaced from said outlet axis (51).

6. The dispenser according to claim 1, and further defining an operational flow direction (56) of the medium through said nozzle duct, wherein said guiding surfaces include orienting means for orienting a media flow transverse to said flow direction (56), between said two nozzle components (53, 54) said media flow annularly directly connecting to said upstream nozzle end, said nozzle duct being straight and defining said outlet axis (51).

7. The dispenser according to claim 6, wherein said guiding surfaces are provided for guiding the medium flow into a swirling rotary flow around said outlet axis (51), said nozzle body (52) being inserted into said inner body member (53) transverse to said outlet axis (51).

8. The dispenser according to claim 6, wherein said nozzle duct includes a downstream nozzle end including said medium outlet (19), said guiding surfaces including first and second guiding surfaces, said nozzle body (52) including said first guiding surfaces directly opposing said upstream nozzle end, said first guiding surfaces being spaced from said upstream nozzle end and said inner body member (53) by a slight gap spacing.

9. The dispenser according to claim 8, and further defining a main dispenser axis (10) including said center axis, wherein said outer body face (57) is oriented parallel to said main dispenser axis (10) and faces towards said medium outlet (19, said outer body face (57) including said first guiding surfaces.

10. The dispenser according to claim 6, wherein for said media flow said outlet duct (18) defines a first flow with an outlet duct flow direction (25) and said guiding surfaces define a guided flow with a second flow direction oriented opposite to said outlet duct flow direction (25), said first flow streaming between said nozzle body (52) and said center axis (10), said guided flow streaming between said two nozzle components (52, 53) and directly angularly connecting to said upstream nozzle end.

11. The dispenser according to claim 6, wherein said nozzle body (52) includes an arcuate jacket wall externally circumferentially defining said outer body face (57) and internally circumferentially defining an inner jacket face remote from said outer body face, said outer body face partially including said guiding surfaces, said inner jacket face bounding a second one of said duct sections, said duct sections including a transverse duct (59) oriented transverse to said first and second duct sections, said transverse duct (59) directly interconnecting said first and second duct sections enveloped by said arcuate jacket wall (53), said arcuate jacket wall (53) being radially spacedly located within said outer jacket, within said outer jacket said common component (11) projecting over said inner body member (53) parallel to said center axis (10).

12. The dispenser according to claim 11, wherein connecting directly upstream to said transverse duct (59) said outlet duct (18) is cross-sectionally bounded by said nozzle body (52) and a duct body (61), said inner body member (53) being made in one part with said base body (6) including an actuating head (12) for manually actuating said dispenser (1), said nozzle body (52) being sealingly pressurized between said arcuate jacket wall (53) and said duct body (61).

13. The dispenser according to claim 1, wherein said inner body member (53) incudes a groove reception (60) fixedly receiving said nozzle body (52), said groove reception including a groove bottom opposed by an edge face, said groove bottom and said edge face commonly bounding a transverse duct (59) oriented transverse to said outlet duct (18) and directly connecting said outlet duct (18) with said guiding means (54), said groove reception (60) including first and second groove flanks, said first groove flank bounding said outlet duct and said second groove flank bounding said guiding means (54), said first and second groove flanks being pressed against said nozzle body (52).

14. The dispenser according to claim 1, wherein a reception depression (60) is provided and receives said nozzle body (52), said reception depression (60) being bounded by inner and outer circumferential flank faces, said inner body member (53) including an outlet wall including said outer circumferential flank face, said outlet wall being traversed by said nozzle duct and including an open wall end, said common component (11) freely projecting out said open wall end, said outer jacket externally including a depression internally bounded by said outlet wall (53).

15. The dispenser according to claim 1, wherein said guide means (54) include a swirl chamber (62) and a swirl duct (63), said swirl duct (63) tangentially issuing into said swirl chamber (62) substantially entirely countersunk in said outer body face (57) and directly covered by said inner body member (53).

16. The dispenser according to claim 1, wherein said guiding means (54) include a swirl duct (63) entirely oriented parallel to said center axis (10), said swirl duct (63) being countersunk in said outer body face (57) and being directly covered by said inner body member (53).

17. The dispenser according to claim 1, wherein said guiding means (54) include a swirl duct (63) bounded by said outer body face (57), said swirl duct being partially oriented transverse to and around said center axis (10), said outer body face (57) being radially pressed against said inner body member (53) and a core body (61) opposing said inner body member (53).

18. The dispenser according to claim 1, wherein said guiding means (54) include guiding depressions (58) exclusively provided in said nozzle body (52) press-fitted against said inner body member (53) and a core body (61) opposing said inner body member (53).

19. The dispenser according to claim 1, wherein between said inner body member (53) and said outer body face (57) said guiding means (54) include a guiding depression (58) defining a depression depth extension, said depression depth extension decreasing towards said outlet axis (51).

20. The dispenser according to claim 1, wherein rotation preventing means are provided for positively preventing rotation of said nozzle body (52) with respect to said inner body member (53), on said nozzle body (52) said rotation preventing means including a locking face (64) opposing said center axis (10) and located remote from said outer body face (57).

21. The dispenser according to claim 20, wherein said rotation preventing means include inner and outer circumferential mounting faces including said locking face (64), in cross-section at least one of said mounting faces being a segment of a circle, said locking face (64) being non-circular and subdivided by a depression (18).

22. The dispenser according to claim 20, wherein said locking face (64) directly bounds said outlet duct (18) and a transverse duct (59) connecting said first duct section with a second duct section of said outlet duct (18), said second duct section directly connecting upstream to said transverse duct (59), said transverse duct (59) directly connecting downstream to said first duct section oriented substantially parallel to said second duct section.

23. A dispenser for discharging media comprising:

a base body (5) defining a center axis (10);

an atomizing nozzle including a nozzle duct, said nozzle duct including a medium outlet (19) and an upstream end remote from said medium outlet (19), said nozzle being assembled from two nozzle components (52, 53); and medium spaces including an outlet duct (18) and said medium outlet (19) defining an outlet axis (51), said outlet duct (18) including duct sections directly connecting to said upstream end and commonly bounded by opposing faces of said two nozzle components (52, 53), transverse to said opposing faces said duct sections defining a duct depth extension transverse to said outlet axis decreasing towards said upstream end.

* * * * *